US009666392B2

(12) United States Patent
Gruenler et al.

(10) Patent No.: US 9,666,392 B2
(45) Date of Patent: May 30, 2017

(54) ELECTRIC SWITCHING DEVICE

(71) Applicant: SIEMENS AKTIENGESELLSCHAFT, Munich (DE)

(72) Inventors: Robert Gruenler, Oranienburg (DE); Volker Lehmann, Treuenbrietzen (DE); Friedrich Loebner, Berlin (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/894,715

(22) PCT Filed: May 2, 2014

(86) PCT No.: PCT/EP2014/058998
§ 371 (c)(1),
(2) Date: Nov. 30, 2015

(87) PCT Pub. No.: WO2014/191154
PCT Pub. Date: Dec. 4, 2014

(65) Prior Publication Data

US 2016/0111234 A1 Apr. 21, 2016

(30) Foreign Application Priority Data

May 30, 2013 (DE) ..... 10 2013 210 136

(51) Int. Cl.
*H01H 3/46* (2006.01)
*H01H 17/26* (2006.01)
(Continued)

(52) U.S. Cl.
CPC ..... *H01H 17/26* (2013.01); *H01H 17/08* (2013.01); *H01H 33/02* (2013.01); *H01H 33/42* (2013.01);
(Continued)

(58) Field of Classification Search
CPC .... H01H 33/666; H01H 11/04; H01H 13/705; H01H 19/04; H01H 19/14; H01H 19/64;
(Continued)

(56) References Cited

U.S. PATENT DOCUMENTS 3,813,506 A * 5/1974 Mitchell ..... H01H 33/666 218/10
4,027,125 A * 5/1977 Peek ..... H01H 3/30 200/308
(Continued)

FOREIGN PATENT DOCUMENTS

CN 1134595 A 10/1996
CN 1328691 A 12/2001
(Continued)

*Primary Examiner* — Truc Nguyen
(74) *Attorney, Agent, or Firm* — Laurence Greenberg; Werner Stemer; Ralph Locher

(57) ABSTRACT

An electric switching device contains a first contact piece and a second contact piece. The first contact piece can be driven by a first kinematic chain. The second contact piece can be driven by a second kinematic chain. The electric switching device contains a first switching point and a second switching point, which are electrically connected in series, the first contact piece being associated with the first switching point and the second contact piece with the second switching point.

8 Claims, 4 Drawing Sheets

(51) Int. Cl.
*H01H 33/02* (2006.01)
*H01H 33/42* (2006.01)
*H01H 17/08* (2006.01)

(52) U.S. Cl.
CPC ..... *H01H 3/46* (2013.01); *H01H 2033/028* (2013.01); *H01H 2205/002* (2013.01)

(58) Field of Classification Search
CPC ..... H01H 1/2041; H01H 1/365; H01H 1/42; H01H 2003/3063; H01H 2205/002; H01H 2223/044; H01H 33/50; H01H 3/30; H01H 3/05
See application file for complete search history.

(56) References Cited

U.S. PATENT DOCUMENTS 4,550,234 A * 10/1985 Steinemer ..... H01H 33/666 200/502
4,814,559 A 3/1989 Stegmuller
5,416,286 A * 5/1995 Dixon, Jr. ..... H01H 1/38 200/16 E
5,550,707 A * 8/1996 Iversen ..... H02B 1/14 200/50.27
5,668,360 A 9/1997 Perret et al.
6,521,855 B2 2/2003 Matsushita et al.
2003/0230553 A1* 12/2003 Kikukawa ..... H01H 33/6661 218/118
2005/0135022 A1* 6/2005 Kinzler ..... H01H 71/0207 361/2
2005/0247677 A1* 11/2005 Perret ..... H01H 33/6661 218/140
2010/0163527 A1* 7/2010 Yoon ..... H01H 33/904 218/62
2015/0027985 A1* 1/2015 Yanagi ..... H01H 33/64 218/46

FOREIGN PATENT DOCUMENTS

CN 1357151 A 7/2002
CN 1959892 A 5/2007
DE 2538899 A1 7/1977
DE 3611270 A1 10/1987
DE 19963256 C1 5/2001
EP 0721197 A1 7/1996
EP 1109185 B1 8/2004
GB 1556498 A 11/1979
WO 0074094 A1 12/2000

* cited by examiner

ELECTRIC SWITCHING DEVICE

BACKGROUND OF THE INVENTION

Field of the Invention

The invention relates to an electric switching device with a first contact piece, a second contact piece, a first kinematic chain for the driving of the first contact piece, and a second kinematic chain for the driving of the second contact piece.

An electric switching device of this type is known, for example, from European Patent specification EP 1109185 B1. The electric switching device described therein is provided with a first and a second contact piece. The first contact piece is associated with a first kinematic chain. The second contact piece is associated with a second kinematic chain. The two contact pieces can be driven by means of the respective kinematic chains. By this arrangement, motive power can be communicated individually to each of the two contact pieces. Accordingly, the movements of the two contact pieces can be mutually synchronized in a simplified manner. Although this permits the simplified synchronization of movements, the axial span of the switching device is increased. In particular, this encumbers integration in existing installations.

BRIEF SUMMARY OF THE INVENTION

A resulting object is therefore the proposal of an electric switching device with improved switching properties which can be incorporated into existing installations.

According to the invention, this object is fulfilled by an electric switching device of the above-mentioned type comprising a first switching point and a second switching point, which are connected in series, wherein the first contact piece is associated with the first contact point and the second contact piece is associated with the second contact point.

An electric switching device is a device which is used for the opening or closing of an electric current path. The first and second contact pieces are thus configured in a moveable arrangement, in order to permit the completion of a switching operation. The first and second contact pieces may be moveable in relation to each other. A switching operation may be completed by the interaction of the two switching points. A switching operation may constitute, for example, a "making operation" or a "breaking operation". Although the first and the second contact pieces are constituent elements of an electric switching device, the two switching contact pieces may be associated with different switching points on the electric switching device. Advantageously, the two switching points should be electrically connected in series, whereby the first contact piece is associated with the first switching point and the second contact piece is associated with the second switching point. In a switching operation, both the first switching point and the second switching point may be actuated. This means that, in a breaking operation, both switching points may be opened, such that two series-connected break sections are formed at the switching points. Conversely, in a making operation, the first break section at the first switching point and the second break section at the second switching point are switched through, such that a closed current path on the electric switching device is formed via the first switching point and the second switching point. The first kinematic chain can be used to drive the first contact piece of the first switching point, and the second kinematic chain can be used to drive the second contact piece of the second switching point. Accordingly, each of the kinematic chains can control one of the switching points of the electric switching device and, in a mutually independent mechanical arrangement, actuate a movement of the moveable contact pieces (both the first and the second contact pieces). By this arrangement, it is possible for the motive power to be transmitted via each of the two kinematic chains to be reduced. For example, it is possible for each of the two kinematic chains to be configured with reduced dimensions, as each of the two kinematic chains is only required to deliver part of the necessary movements required for the switching of the electric switching device. In particular, it may be provided that both the first contact piece and the second contact piece are continuously maintained at one and the same electrical potential. However, the two contact pieces may be mutually arranged to move in relation to each other. In particular, during a switching operation, the motion delivered by the respective kinematic chain may drive the two contact pieces in opposite directions. In particular, it may be provided that the two contact pieces execute a linear motion, whereby the axes of motion of the first and second contact pieces lie in a near-parallel axis. In particular, the axes of motion may be configured in a mutually coaxial arrangement. The two contact pieces may respectively comprise a rated current contact piece or an arcing contact piece, or a combined rated current and arcing contact piece. In this case, the function of an arcing contact piece is essentially the conduction of an arc, in order to protect a rated current contact piece associated with the respective arcing contact piece against erosion. The function of the rated current contact pieces is the conduction of current. A protective function of this type may be achieved by the mutual contact of the arcing contact pieces in advance of the rated current contact pieces, such that pre-arcing occurs on the arcing contact pieces and, upon the contact of the rated current contact pieces, a low-arc switching of current from an arcing contact piece current path to a rated current contact piece current path is executed. In a breaking operation, conversely, it may be provided that the rated current contact pieces are separated first, such that a current flowing in the rated current contact piece current path is switched to the arcing contact piece current path and, upon the separation of the arcing contact pieces, any arc ignited is directed to the arcing contact pieces. An arrangement of this type is known, for example, in high-voltage power switches. However, it may also be provided that the first and/or the second contact piece combine a rated current function with an arcing function, such that the provision of separate arcing contact pieces and rated current contact pieces is not required.

By dividing a contact gap in the electric switching device into a first switching point and a second switching point, it is possible, for example, to divide switching arcs generated between a number of contact gaps, such that the simplified extinction of said switching arcs is facilitated accordingly. Moreover, each of the switching points can be optimally designed in respect of its anticipated respective switching arc, such that each of the switching points is only required to control a partial arc. Correspondingly, further to the extinction of an arc in the two break sections, an expanded contact gap is formed, as the two break sections are electrically connected in series. Moreover, the respective throw of the two contact pieces, which are moveable by means of the two kinematic chains, is reduced in relation to a simple and correspondingly expanded switching point. A twin drive arrangement of the two contact pieces also provides a simple option for increasing a contact break speed, such that an electrically isolating contact gap in the electric switching device is achieved more rapidly. Moreover, by means of division into a number of break sections, the mass of the moving components in each kinematic chain can be reduced, such that the motive power to be transmitted via the two kinematic chains can be reduced accordingly. In particular, it should advantageously be provided that the two switching points are of identical construction such that, for example, both the first and the second contact pieces can be of identical design. For example, the two switching points can be identically configured by the configuration, for example, of two identical switching devices arrange in opposite directions, such that the first contact piece and the second contact piece are permanently in mutual and electrically conductive contact. For example, the two switching devices may be mounted, at least partially, on a series-contacting node point of the two switching points.

It may also be advantageously provided that the first switching point is configured with a third contact piece and the second switching point is configured with a fourth contact piece, whereby the first contact piece is moveable in relation to the third contact piece, and the second contact piece is moveable in relation to the fourth contact piece.

For the configuration of the first switching point, a third contact piece is associated with the first contact piece. For the configuration of the second switching point, a fourth contact piece is associated with the second contact piece. The first contact piece and the third contact piece should be of diametrically opposite design. The second contact piece and the fourth contact piece should also be of diametrically opposite design, such that galvanic contact between the first and the third contact piece, or between the second and the fourth contact piece, is possible. To this end, at least the first and the second contact pieces should be moveable, and mounted for propulsion by the respective kinematic chain such that, at both the first switching point and at the second switching point, a break section can be formed for the electrical isolation of the first and third contact pieces, or of the second and fourth contact pieces. The third and fourth contact pieces, for example, may be arranged in a stationary position. For the generation of a relative movement between the first and third, or between the second and fourth, contact pieces it may also be provided that the third contact piece is mounted in a moveable arrangement and/or that the fourth contact piece is mounted in a moveable arrangement. Accordingly, at the first and/or at the second switching point, it is possible to execute a switching motion by a movement of the first and third or of the second and fourth contact pieces.

As a result, for example, the contact opening speed or contact closing speed between the first and third contact pieces at the first switching point and/or between the second and fourth contact pieces at the second switching point can be further increased. For example, the first contact piece, which is actuated by means of the first kinematic chain, may be associated with an insulating material component which communicates a movement from the first switching point to the third contact piece. Likewise, on the second switching point, provision may be made for the use of an insulating material component which communicates a movement from the second contact piece via the second switching point to the fourth contact piece. Preferably, a gearing arrangement is applied in each case which converts the movement of the respective insulating material component, in particular by the inversion thereof, such that an inverse movement between the first and third or between the second and fourth contact pieces is dictated accordingly. In each case, for example, the insulating material component employed may be an insulating material nozzle which surrounds a switching point, or at least sections thereof. The insulating material nozzle can also be used to control a flow of a switching gas. For example, switching gas may be fed via the insulating nozzle to the area of the contact gap, such that any arc ignited at this location in association with a breaking operation is blown-out and cooled. It is therefore possible that each of the two switching points is provided with contact pieces which are moveable in relation to each other, whereby the contact pieces arranged respectively on either side of the respective switching point are set in motion during a switching operation. Accordingly, the contact opening speed at each of the two switching points can be further increased and, overall, the switching speed of the electric switching device which is provided with the two series-connected switching points can be increased.

Advantageously, it may be provided that the first contact piece and the second contact piece are arranged to move relatively to each other.

The first and the second contact pieces may be arranged to move relatively to each other. In particular, the two contact pieces may be mounted to move in opposite directions. By this arrangement, for example, it is possible, centrally on the electric switching device, to combine a movement of the first kinematic chain and a movement of the second kinematic chain in the electric switching device and, in the area of electrical contact (node point) of the two switching points, to communicate a movement to branches of the electric switching device which incorporate the first switching point or the second switching point. Accordingly, an essentially symmetrical electrical switching device can be produced, the axially opposite ends of which can be maintained free of driving means of the kinematic chain. The driving means/kinematic chains preferably engage with the electric switching device in radial directions. The electric switching device should preferably extend longitudinally in an essentially cylindrical arrangement (for example, a cylindrical base component), with a shell-side coupling of the kinematic chain or a shell-side arrangement of driving means. Accordingly, the end faces of the electric switching device can be maintained free of driving means or kinematic chains.

In a further advantageous configuration, it may be provided that the first kinematic chain and the second kinematic chain operate in a mutually independent mechanical arrangement.

Independent operation of the kinematic chains ensures that each of the two switching points can be controlled and moved in an independent mechanical arrangement from the other switching point. For example, movements on each of the two switching points can be synchronized, independently of each other. In particular, in the event of malfunctions on one of the kinematic chains, the other kinematic chain can remain in service. In a breaking operation, for example, it is therefore possible for at least one of the switching points to be opened by one of the kinematic chains, whereas the other switching point may be blocked in a fault position. To this end, the kinematic chains are mechanically independent of each other. By means of further devices, however, for example control devices, the movements of the kinematic chains can be synchronized relatively to each other. For example, a control device may compare progress in the movement of one of the kinematic chains with the progress of the other kinematic chain, thereby ensuring a secure switching of the electric switching device.

It may also be advantageously provided that the first kinematic chain is provided with a first driving means and the second kinematic chain is provided with a second driving means.

The function of the first kinematic chain is the communication of a movement to the first contact piece. The function of the second kinematic chain is the communication of a movement to the second contact piece. The function of a kinematic chain is the transmission of a movement from a driving means of said kinematic chain to at least the first or the second contact piece. The driving means in the respective kinematic chains are designed for the generation, retention, intermediate storage or delivery of motive power. Appropriate driving means may include, for example, hydraulic driving means, electric driving means or mechanical driving means, such as spring-loaded drive systems. From the driving means, the respective kinematic chain is routed to at least the first or the second contact piece. Where applicable, the kinematic chain may be extended to further components including, for example, the third or fourth contact piece, a moveable shield electrode, a moveable compression device, etc. A kinematic chain may show a wide variety of configurations. For example, the kinematic chain may be provided with transmission rods, reversing levers, gearing, toothed wheels, cable pulls, toothed racks, etc., such that a movement generated by one of the respective driving means is transmitted, either correspondingly or reciprocally, by the action of gearing in the kinematic chain, to the first or the second contact piece.

In a further advantageous configuration, it may be provided that the first driving means and the second driving means are configured in a diametrically opposite arrangement to an axis of symmetry of the electric switching device.

A diametrically opposite arrangement of the two driving means relative to an axis of symmetry has the advantage that units of identical design can preferably be used for both the first and the second driving means. A symmetrical design permits a compact arrangement for the transmission of a movement from the first or second driving means via the respective kinematic chain to the respective contact piece. For example, the diametrically opposite arrangement of the driving means may be analogous to a diametrically opposite arrangement of the first and second switching points. For example, it is therefore possible, in the area of the series connection (node point) of the first and second switching points, to transmit a movement to both the first and the second contact pieces. In a corresponding diametrically opposite arrangement, the two contact pieces can move in opposite directions relative to the axis of symmetry.

In a further advantageous configuration, it may be provided that opposing movements are communicated by the kinematic chains to the first and second contact pieces.

By the opposing movement of the first and second contact pieces, it is possible for electric switching devices to be configured as compactly as possible, whereby, by the opposing movement of the two contact pieces during a switching operation, movement can be communicated centrally between the two contact pieces. An opposing movement may be linear, circular, swiveling, etc.

In a further advantageous configuration, it may be provided that the two kinematic chains are mechanically separated from each other, wherein the movements thereof are synchronized.

As a result of a mechanical separation of the two kinematic chains, mechanical faults on one kinematic chain cannot be transmitted to the other kinematic chain. For example, an immobilization of one kinematic chain will not cause consequential damage in the other kinematic chain. It is therefore still possible, for example, notwithstanding a mechanical fault on one of the kinematic chains, for the mechanism of the other kinematic chain to be actuated. Synchronization of both movements of the kinematic chain is advantageous, in order to prevent any overloading of one of the switching points. By the interaction of the two contact pieces of the two switching points, it is possible for a switching operation (making operation; breaking operation) to be controlled by the electric switching device. For example, sensors may be used to detect progress in a movement of one of the kinematic chains. Where applicable, in the event of a deviation in the movements of the contact pieces from predetermined patterns of movement, a characteristic associated fault can be identified in advance, such that the electric switching device, for example, may be locked out for further switching operations as a precautionary measure.

In a further advantageous configuration, it may be provided that the connection of the kinematic chains to the respective contact piece is effected between the switching points.

The area between the switching points is the area (for example the central node point) in which contact is formed by the switching points for the formation of a series connection. The two switching points should preferably be configured in a mutually spaced arrangement on a longitudinal axis, whereby movements of the kinematic chain are communicated to the first or second contact piece between the two switching points in relation to the longitudinal axis. This area between the two switching points is the area in which the two switching points, by means of electrical bonding, are maintained in continuous mutual conductive electrical contact, such that contact pieces which are bonded with said area, and which are moveable by means of the first or second kinematic chain, will also be at the same electrical potential. Accordingly, this area is a central area in the axial profile of the electric switching device, in relation to the longitudinal axis.

BRIEF DESCRIPTION OF THE SEVERAL VIEWS OF THE DRAWING

Hereinafter, one exemplary embodiment is schematically represented in a drawing and is then described in greater detail. Herein.

DESCRIPTION OF THE INVENTION

Figure 1:
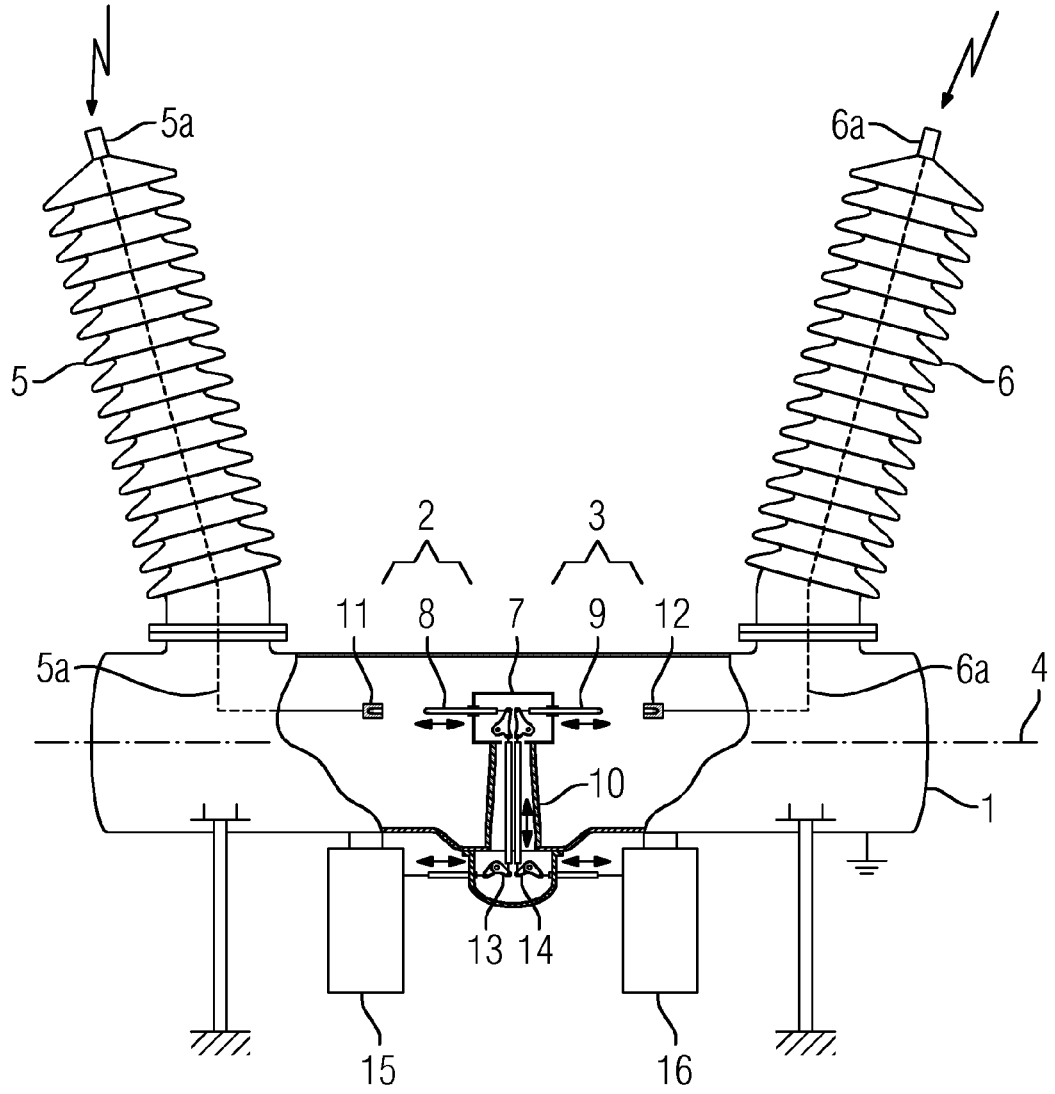
FIG. 1 shows a side view of an electric switching device, with a partial cutaway.

FIG. 1 shows a side view of an electric switching device of "dead tank" design. The electric switching device is provided with a housing 1. The housing 1 encloses a first switching point 2 and a second switching point 3. In this case, the housing 1 is configured such that it hermetically encloses the two switching points 2, 3. The housing 1 acts as a fluid-tight barrier. The housing 1 comprises a cylindrical base component with a longitudinal axis 4. The housing 1 may be comprised of various materials or material combinations. In this case, the housing 1 is configured with a base component of a metallic material, which is at ground potential and essentially extends in a cylindrical arrangement with respect to the longitudinal axis 4. The housing 1 is also provided with a first exterior bushing 5 and a second exterior bushing 6. The two exterior bushings 5, 6 constitute electrically insulating sections of the housing 1, through which phase conductors 5*a*, 6*a* may be routed to the interior of the housing 1 in an electrically insulated arrangement. The phase conductors 5*a*, 5*b* pass through the barrier of the housing 1 in an electrically insulated arrangement, and penetrate the interior of the metallic base component of the housing 1. The phase conductors 5*a*, 5*b* are accommodated in the interior of the housing 1 in an electrically insulated arrangement. For the purposes of electrical insulation, the housing 1 is filled with an electrically insulating fluid. Suitable electrically insulating fluids include, for example, gaseous sulfur hexafluoride, gaseous nitrogen, gaseous carbon dioxide or mixtures of said gases. Optionally, the substances may also be present in the interior of the housing 1 in the liquid state. Alternatively, fluids such as insulating oils or insulating esters in liquid form may also be used. In order to increase the insulation withstand of the fluid, the latter may be subjected to overpressure. In this case, the housing 1 acts as a pressure vessel.

In the interior of the housing 1, the two phase conductors 5*a*, 6*a* may be mutually electrically bonded or separated at the first switching point 2 and the second switching point 3. To this end, the two switching points 2, 3 are electrically connected in series via a central node point 7. On the central node point 7 of the electric switching device, a first contact piece 8 and a second contact piece 9 are, firstly, electrically bonded with the node point 7 and, secondly, are mounted to permit axial displacement relative to the node point 7. The two contact pieces 8, 9 are of identical design. Schematically, FIG. 1 shows that the first contact piece 8 and the second contact piece 9 are configured respectively in the form of studs, whereby the stud axes of the two contact pieces 8, 9 are arranged in the direction of the longitudinal axis 4, and the contact pieces 8, 9 are mounted to permit axial displacement on the central node point 7. The central node point 7 may, for example, be a metallic hollow body, mounted on a post insulator 10 fitted to the interior wall of the housing 1. Accordingly, the node point 7 is electrically insulated in relation to the housing 1, and consequently shows a "floating" electrical potential, i.e. the potential of the node point 7 varies according to the circuit state of the two switching points 3, 2.

The first and second contact pieces 8, 9 are permanently bonded in a mutually electrically conductive arrangement via the second node point. For example, the contact pieces 8, 9 may be electrically bonded with the node point 7 by means of a sliding contact arrangement. On the first switching point 2, a third contact piece 11 is arranged opposite the first contact piece 8. Analogously, on the second switching point 3, a fourth contact piece 12 is arranged opposite the second contact piece 9. The third and fourth contact pieces 11, 12 are of diametrically opposite design to their associated respective first or second contact pieces 8, 9. In this case, the third contact piece 11 and the fourth contact piece 12 are configured as bushes, with which the relatively moveable contact piece 8 or the relatively moveable contact piece 9 are designed to engage, for the purposes of bonding. In this case, the third contact piece 11 and the fourth contact piece 12 are mounted in a stationary arrangement and are electrically insulated from the housing 1. The third contact piece 11 is provided with an electrically conductive bond to the phase conductor 5*a* of the first exterior bushing 5, and is bonded to the latter in a rigid angular arrangement. The fourth contact piece 12 is provided with an electrically conductive bond to the phase conductor 6*a* of the second exterior bushing 6, and is bonded to the latter in a rigid angular arrangement. The first switching point 2 and the second switching point 3 are arranged between the phase conductors 5*a*, 6*a* of the two exterior bushings 5, 6, whereby the two switching points 2, 3 (via the central node point 7) are electrically connected in series, such that a current path running via the phase conductors 5*a*, 6*a* of the exterior bushings 5, 6 may be closed or separated by means of the two switching points 2, 3.

The post insulator 10 is a rotationally symmetrically hollow body, the first end of which is bonded to the node point 7, and the second end of which is supported on the inner shell side of the housing 1. By means of the post insulator 10, the node point 7 is maintained in proximity to other components which are fitted thereto, such as, for example, the first contact piece 8 and the second contact piece 9. A first kinematic chain 13 is provided for the movement of the first contact piece 8. A second kinematic chain 14 is provided for the movement of the second contact piece 9. The first kinematic chain 13 is provided with a first driving means 15. The second kinematic chain 14 is provided with a second driving means 16. The two driving means 15, 16 generate a movement, which is communicated to the first or second contact pieces 8, 9 respectively via the first or second kinematic chains 13, 14 respectively. In this case, the two driving means 15, 16 are of identical design, and are arranged on the outer shell side of the first housing 1. In this case, the two driving means 15, 16 are each configured as spring-loaded drive systems, i.e. each of the two driving means 15, 16 is provided with at least one storage spring, which is tensioned, and the energy of which is then delivered upon release and communicated to the first or second contact pieces 8, 9. The kinematic chains 13, 14 each penetrate the barrier of the housing 1 in a fluid-tight arrangement, such that the driving means 15, 16 are arranged outside the housing 1, and movement can be transmitted to the interior of the housing 1 through the wall of said housing 1, whereby the fluid-tightness of the housing 1 is maintained. For example, the kinematic chains 13, 14 may each be provided with a rotatable shaft, which penetrates a wall of the housing 1 and is sealed by means of a rotary seal. Sealing elements for the maintenance of leak-tightness in respect of axial movements may also be used, in order to permit the translation of a movement to the interior of the housing 1 by means of a linearly displaceable element of the kinematic chains 13, 14.

Figure 2:
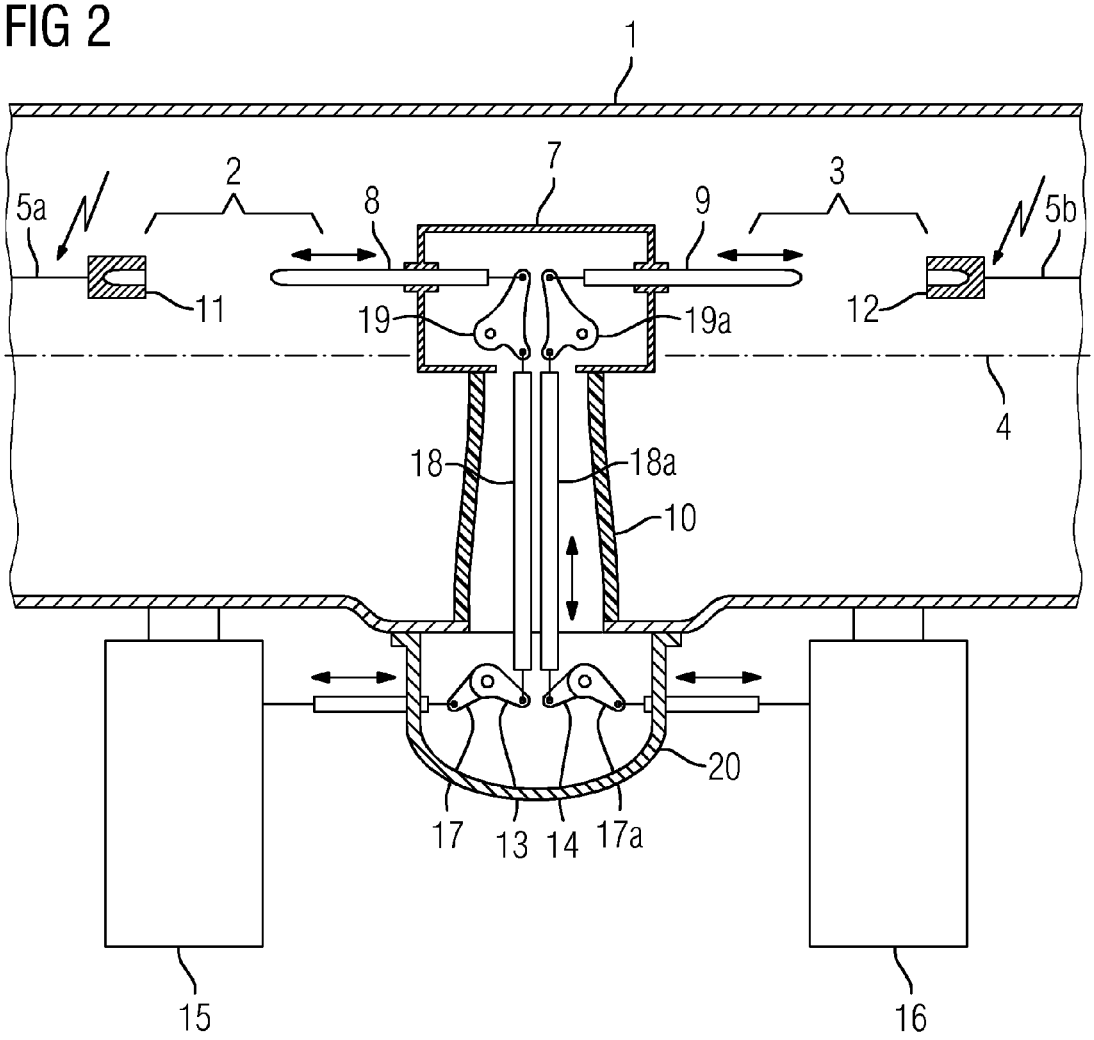
FIG. 2 shows an expanded section of the cutaway represented in FIG. 1.

FIG. 2 shows an enlargement of the partial cutaway section of the electric switching device represented in FIG. 1. The configuration of the first and second contact pieces 8, 9, and of the third and fourth contact pieces 11, 12, is represented schematically. However, the first and second, or the third and fourth contact pieces 8, 9, 11, 12 may also show a different construction. For example, separate rated current or arcing contact pieces may be assigned respectively to the contact pieces 8, 9, 11, 12, in order to permit the time-displaced closing of the rated current and arcing current paths at the first switching point 2 or the second switching point 3. In particular, the switching points 2, 3 may be configured in each case as a power switch which is designed for simple interruption. An electric switching device configured according to the invention can be configured independently of the actual configuration of the contact pieces 8, 9, 11, 12.

FIG. 2 shows a detail of the kinematic chains 13, 14 known from FIG. 1. By way of an example, the design of the first kinematic chain 13 will firstly be described. The second kinematic chain 14 is configured with a diametrically opposite design. Sub-assemblies of equivalent function carry reference numbers with the additional letter "a". The first kinematic chain 13 is provided with a first driving means 15. The first driving means 15 is designed to deliver a linear movement, which essentially runs in parallel to the longitudinal axis 4. By means of a first reversing lever 17, which is mounted in a stationary pivoting arrangement in relation the housing 1, this linear movement is displaced through 90°, such that an initial linear movement delivered by the first driving means 15 in the direction of the longitudinal axis 4 is translated into a movement which essentially runs at right angles to the axis of movement of the movement delivered by the first driving means 15. By means of a coupling rod 18, which is routed in the interior of the post insulator 10, this movement is transmitted to the interior of the node point 7. A further reversing lever 19 is arranged in the interior of the node point 7, by means of which a linear movement of the coupling rod 18 is displaced through a further 90°, and this translated movement can again run in the direction of the longitudinal axis 4. By this arrangement, the movement communicated to the first reversing lever 17 in the direction of the longitudinal axis runs in an opposite direction to the movement communicated by the further reversing lever 19, which also runs in the direction of the longitudinal axis 4. These two axes of movement are arranged with a lateral displacement between them, which is bridged by means of the coupling rod 18. The movement communicated by the further reversing lever 19 is communicated to the first contact piece 8, such that the first contact piece 8 can be moved in parallel to the longitudinal axis 4. In addition, the first contact piece 8 is mounted to permit axial movement on the node point 7. By means of the moveable mounting on the node point 7, an electrical bonding (e.g. by sliding contacts) of the first contact piece 8 with the node point 7 is also ensured. The second kinematic chain 14 is provided with a diametrically opposite design, whereby an axis of symmetry is essentially perpendicular to the longitudinal axis 4 (in side view). It is therefore possible for the two driving means 15, 16, acting in opposite directions, to deliver movement in the direction of the longitudinal axis 4, said movement being correspondingly displaced by means of reversing levers 17, 17*a*, transmitted via coupling rods 18, 18*a* and the movement is again displaced further displaced in the direction of the longitudinal axis 4 by means of further reversing levers 19, 19*a*, whereby the movement delivered by the driving means 15, 16 in the direction of the longitudinal axis 4 is respectively oriented in opposite directions, and the movements of the first and second contact pieces 8, 9 are aligned in opposition. Correspondingly, driven by the first kinematic chain 13, the first contact piece 8 can be moved in the opposite direction to the second contact piece 9, which is driven by the second kinematic chain 14. For the coupling of the kinematic chain in the interior of the housing 1, a shell-side cap 20 is arranged on the housing 1 in the area of attachment of the post insulator 10. Said cap 20 accommodates the fluid-tight penetration of the first or second kinematic chains 13, 14 into the interior of the housing 1.

Figure 3:
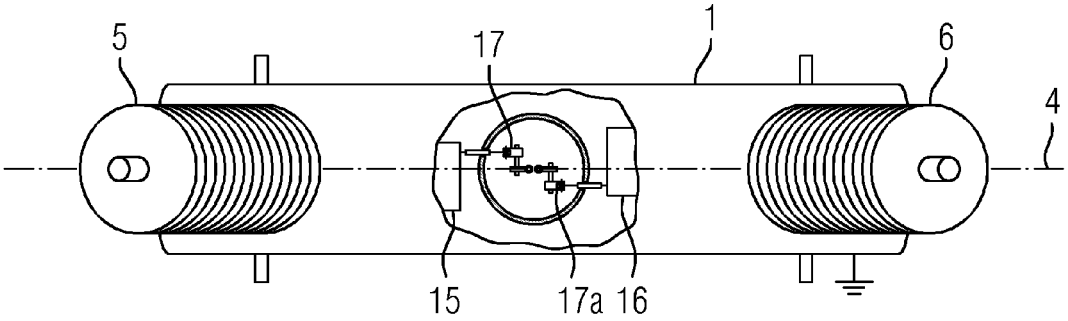
FIG. 3 shows an overhead view of the electric switching device represented in FIG. 1, with a partial cutaway.
Figure 4:
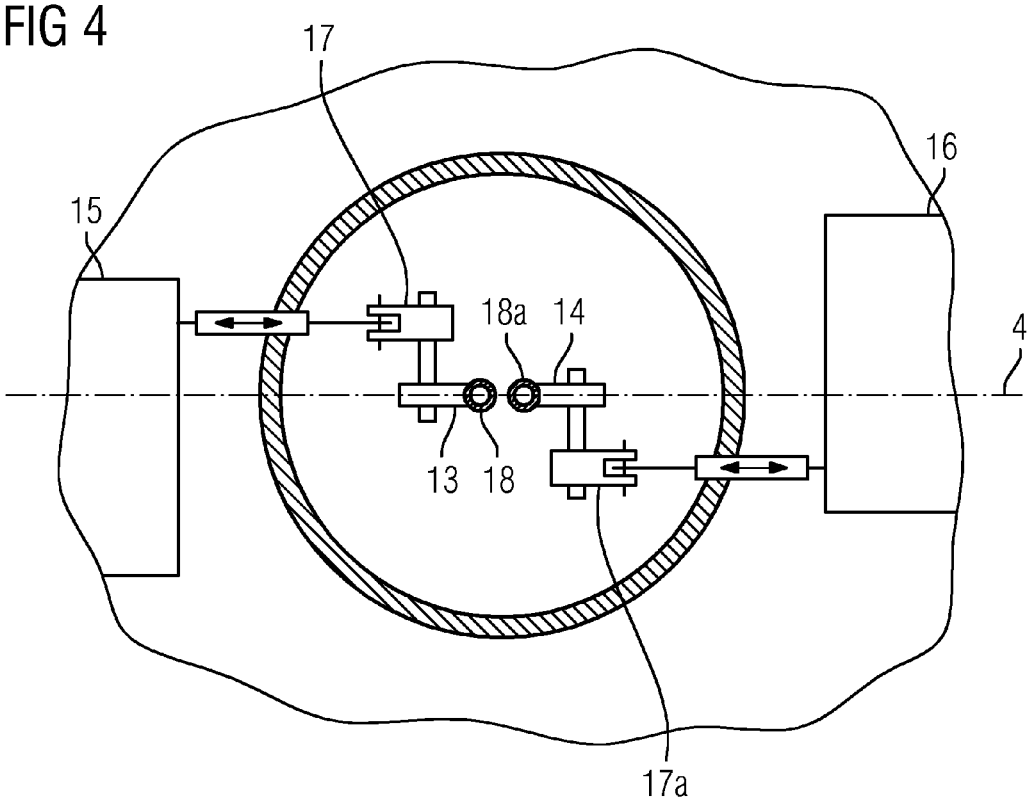
FIG. 4 shows an expanded view of the cutaway section of the electric switching device represented in FIG. 3.

FIG. 3 shows an overhead view of the electric switching device represented in FIGS. 1 and 2. The housing 1 can be seen, the base component of which is essentially configured as a cylinder along the longitudinal axis 4, whereby the two exterior bushings 5, 6 can be seen in overhead view. A central cutaway is shown, which fully penetrates the shell surface of the housing, thereby permitting an overhead view of the first driving means 15 and the second driving means 16. FIG. 4 shows an enlargement of the cutaway from FIG. 3. The two driving means 15, 16 deliver a linear movement in the direction of the longitudinal axis 4, whereby the two driving means 15, 16 are configured in a diametrically opposite arrangement relative to an axis of symmetry. In overhead view, the axis of symmetry also runs transversely, in particular at 90°, to the longitudinal axis 4. The axis of symmetry in side view and the axis of symmetry in overhead view enclose a plane which is essentially perpendicular to the longitudinal axis 4. The configuration of the two-armed reversing levers 17, 17*a* can be seen, the axially spaced arms of which are each mounted on a shaft, such that the shafts of each reversing lever 17, 17*a* are configured in a centrally pivoting arrangement. The two coupling rods 18, 18*a* of the first or second kinematic chains 13, 14 run perpendicularly to the drawing plane of FIG. 4, and are displaceable in the direction of this axis.

Figure 5:
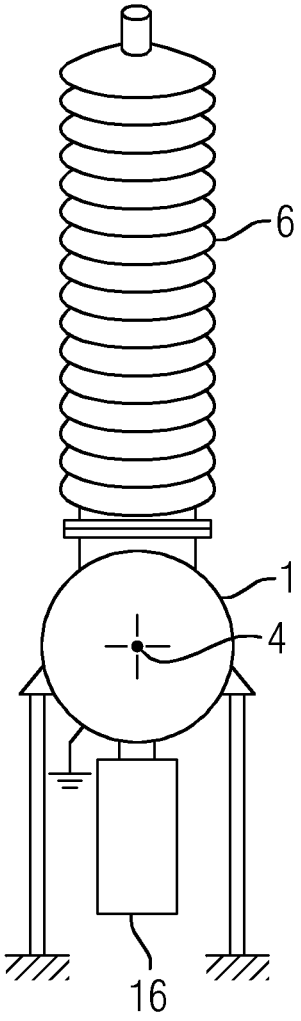
FIG. 5 shows an end-on view of the electric switching device.

FIG. 5 shows an end-on view of the housing 1, wherein the second driving means 16 is arranged to face the viewer of FIG. 5. The second exterior bushing 6 also faces the viewer. It will be seen that the housing 1 is provided with a base component of essentially circular cross-section, whereby both the driving means 15, 16 and the exterior bushings 5, 6 are arranged on the shell side. The exterior bushings 5, 6 and the driving means 15, 16 are configured in a diametrically opposite arrangement relative to the longitudinal axis 4.

The invention claimed is:

1. An electric switching device, comprising:

a first contact piece;

a second contact piece;

a first kinematic chain for driving said first contact piece;

a second kinematic chain for driving of said second contact piece, said first kinematic chain and said second kinematic chain operate in a mutually independent mechanical arrangement independent from each other;

a first switching point being associated with said first contact piece; and a second switching point connected in series with said first switching point, said second contact piece being associated with said second contact point.

2. The electric switching device according to claim 1, wherein:

said first switching point is configured with a third contact piece and said first contact piece is moveable in relation to said third contact piece; and said second switching point is configured with a fourth contact piece, and said second contact piece is moveable in relation to said fourth contact piece.

3. The electric switching device according to claim 1, wherein said first contact piece and said second contact piece are disposed to move relatively to each other.

4. The electric switching device according to claim 1, further comprising:

a first drive for driving said first kinematic chain; and a second drive for driving said second kinematic chain.

5. The electric switching device according to claim 1, wherein said first drive and said second drive are configured in a diametrically opposite arrangement to an axis of symmetry of the electric switching device.

6. The electric switching device according to claim 5, wherein opposing movements are communicated by said first and second kinematic chains to said first and second contact pieces.

7. The electric switching device according to claim 1, wherein said first and second kinematic chains are mechanically separated from each other, wherein movements of said first and second kinematic chains are synchronized.

8. The electric switching device according to claim 1, wherein said first and second switching points are effected by a connection of said first and second kinematic chains, respectively to said first and second contact pieces, respectively.

* * * * *